US007128525B2

(12) United States Patent
Tsai

(10) Patent No.: US 7,128,525 B2
(45) Date of Patent: Oct. 31, 2006

(54) AIR PUMP

(75) Inventor: Chun-Chung Tsai, Dongguan (CN)

(73) Assignee: Ho Lee Co., Ltd., Taipei Hsien (TW)

( * ) Notice: Subject to any disclaimer, the term of this patent is extended or adjusted under 35 U.S.C. 154(b) by 177 days.

(21) Appl. No.: 11/023,482

(22) Filed: Dec. 29, 2004

(65) Prior Publication Data

US 2006/0140759 A1 Jun. 29, 2006

(51) Int. Cl.
*F04D 29/40* (2006.01)

(52) U.S. Cl. ..... 415/128; 415/144; 415/167

(58) Field of Classification Search ..... 415/126, 415/127, 128, 244, 167
See application file for complete search history.

(56) References Cited

U.S. PATENT DOCUMENTS 3,147,909 A * 9/1964 Novitsky ..... 415/127
3,375,539 A * 4/1968 Loepsinger ..... 15/312.1
6,413,056 B1 * 7/2002 Chou ..... 417/366

* cited by examiner

*Primary Examiner*—Edward K. Look
*Assistant Examiner*—Dwayne J White
(74) *Attorney, Agent, or Firm*—Rosenberg, Klein & Lee

(57) ABSTRACT

An air pump has a casing, a motor assembly, a fan assembly, a faceplate and a sliding valve assembly. The motor assembly is mounted in the casing and has a motor. The fan assembly has a fan housing, an inlet manifold, an inlet plate and a centrifugal impeller. The centrifugal impeller is mounted rotatably in the fan housing and connects to the motor. The sliding valve assembly is hollow, is mounted slidably between the faceplate and the motor assembly and has a rear, a partition and an air passage. The partition extends into the sliding valve assembly. The air passage is formed between the partition and the rear. The air pump inflates when the air passage aligns with in the inlet manifold. The air pump deflates when the air passage aligns with the fan housing.

6 Claims, 4 Drawing Sheets

AIR PUMP

BACKGROUND OF THE INVENTION

1. Field of the Invention

The present invention relates to air pump, especially to an air pump that can inflate and deflate without being disconnected and reconnected.

2. Description of the Prior Arts

Inflatable articles such as inflatable boats, inflatable pools, inflatable mattresses, etc. need to be inflated to be used. Inflatable articles are often large so using an air pump to inflate or to deflate them is quick and convenient. The inflatable article has an inflation hole for inflation and deflation. The conventional air pump comprises an air inlet, an air outlet, a fan and a motor. The motor rotates the fan, and the fan draws air into the air inlet and discharges air through the air outlet. When an inflatable article has to be inflated, the inflation hole in the inflatable article is attached to the air outlet of the conventional air pump. When the inflatable article has to be deflated, the inflation hole in the inflatable article is attached to the air inlet of the conventional air pump. Alternatively, the direction of rotation of the motor can be reversed so the air inlet functions as the air outlet and the air outlet functions as the air inlet when the fan is a propeller or vane-axial fan. However, reversing the rotation of the motor attached to centrifugal fans will likely be ineffective. Furthermore reversing the rotation of the motor may be more inconvenient than simply changing whether the air inlet or the air outlet is attached to the inflation hole.

To overcome the shortcomings, the present invention provides an air pump that can inflate and exhaust without changing contact or reversing motor to mitigate or obviate the aforementioned problems.

SUMMARY OF THE INVENTION

The main objective of the present invention is to provide an air pump that can selectively inflate or deflate an inflatable article without being disconnected or reversing the motor in the air pump.

The air pump comprises a casing, a check valve assembly, a motor assembly, a fan assembly, a faceplate and an sliding valve assembly. The motor assembly is mounted in the casing and has a motor. The fan assembly has a fan housing, a inlet manifold, an inlet plate and a centrifugal impeller. The centrifugal impeller is mounted rotatably in the fan housing and connects to the motor. The sliding valve assembly is hollow, is mounted slidably between the faceplate and the motor assembly and has a rear, a partition and an air passage. The partition extends into the sliding valve assembly. The air passage is formed between the partition and the rear. The air pump inflates when the air passage is aligned with the inlet manifold. The air pump deflates when the air passage is aligned with the fan housing.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
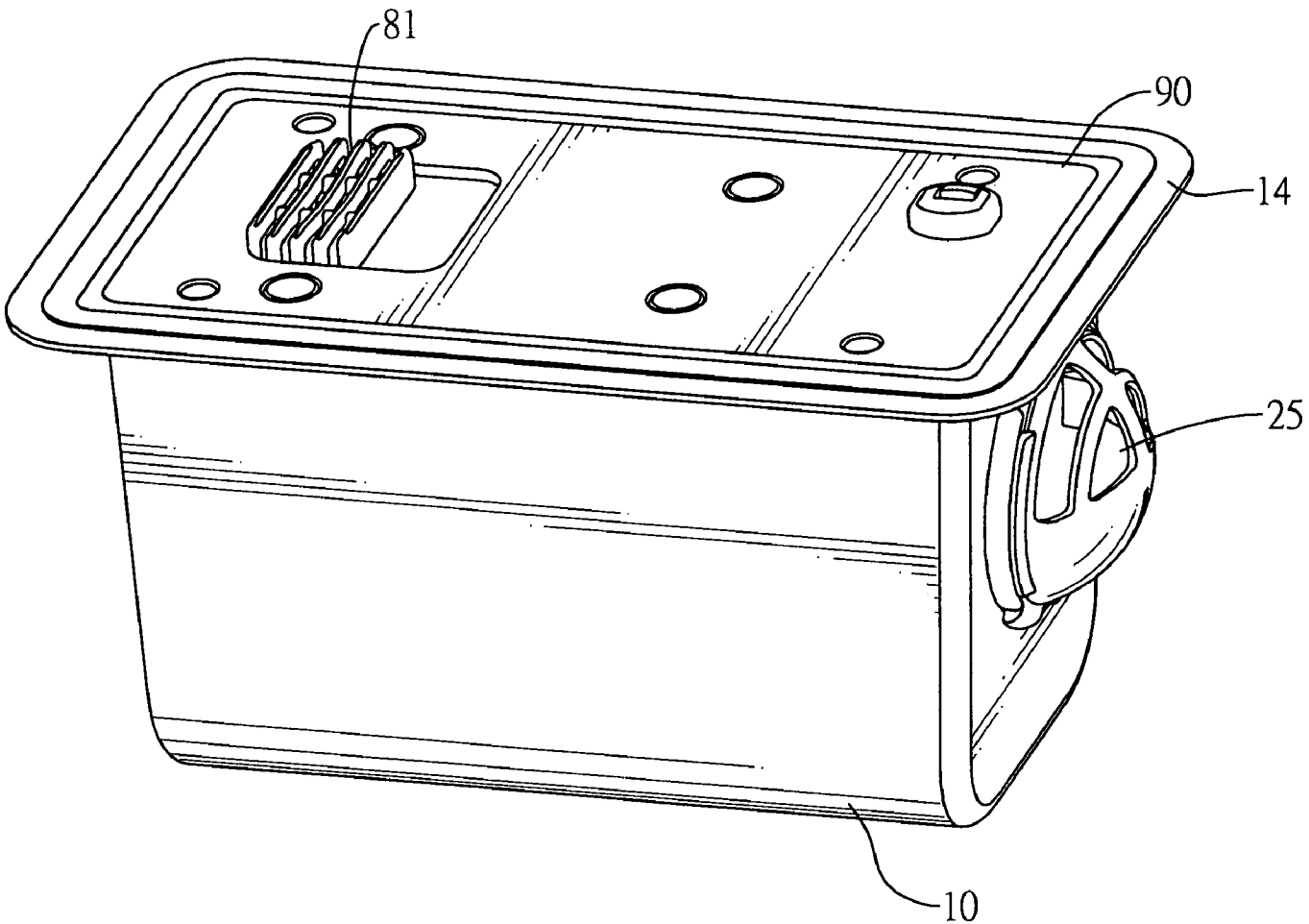
FIG. 1 is a perspective view of an air pump in accordance with the present invention.
Figure 2:
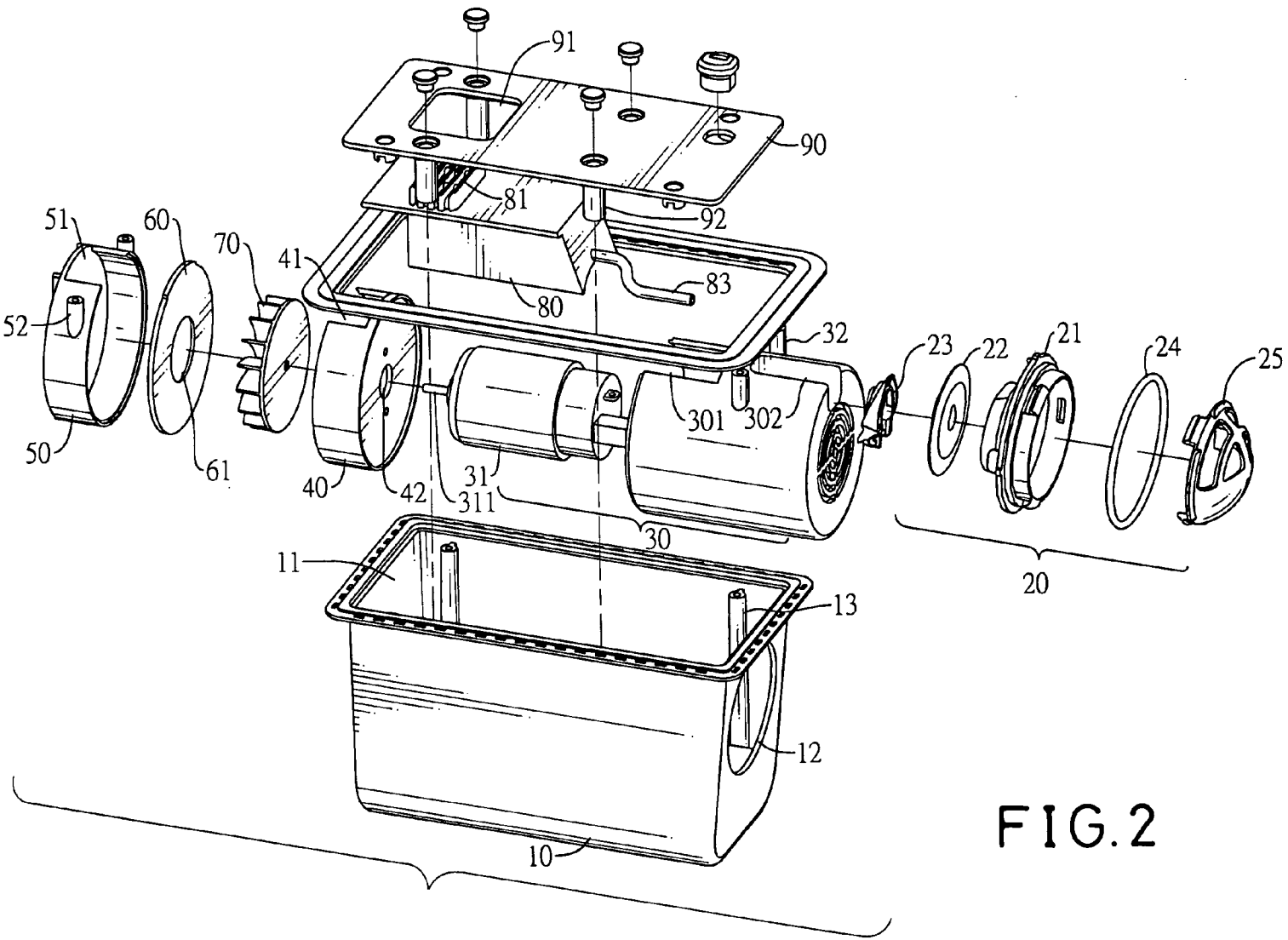
FIG. 2 is an exploded perspective view of the air pump in FIG. 1.

With reference to FIGS. 1 and 2, an air pump in accordance with the present invention comprises a casing (10), a check valve assembly (20), a motor assembly (30), a fan assembly, a faceplate (90) and a sliding valve assembly (80).

The casing (10) is hollow and has a top, a front, a cavity (11), inner walls, a top opening, faceplate frame (14), a front hole (12) and four optional posts (13). The top opening is formed in the top. The faceplate frame (14) is attached to the top opening. The front hole (12) is formed through the front. The posts (13) are formed vertically on the inner walls.

The check valve assembly (20) is mounted in the front hole (12) in the front of the casing (10) and comprises a valve body (21), a disk (22), an activator (23), an optional gasket (24) and an optional cover (25). The valve body (21) is mounted securely in the front hole (12) and has an inner opening and an outer opening. The disk (22) is attached to and closes the inner opening in the valve body (21) and has an inside surface. The activator (23) is mounted moveably in the valve body (21), is attached to the inside surface of the disk (22) to selectively push the disk (22) to open the inner opening in the valve body (21) and may be mounted pivotally on the valve body (21). The gasket (24) is mounted around the valve body (21). The cover (25) clamps on the outer opening of the valve body (21) and has multiple through holes.

The motor assembly (30) is mounted in the cavity (11) in the casing (10) optionally against the posts (13) in the casing (10) and comprises a cylinder and a motor (31). The cylinder is hollow and has a front, a rear, a top, multiple holes, an opening (301), a recess (302) and multiple optional posts (32). The holes are formed in the front of the cylinder. The opening (301) is formed in the rear and top of the cylinder. The recess (302) is formed in the front and top of the cylinder. The posts (32) are formed on the top of the cylinder. The motor (31) is mounted in the cylinder and has a center and a drive shaft (311). The drive shaft (311) is mounted in the center of the motor (31) and protrudes out of the rear of the cylinder.

The fan assembly is mounted in the cavity (11) of the casing (10), is attached to and driven by the motor (31) and comprises a fan housing (40), an inlet plate (60), an inlet manifold (50) and a centrifugal impeller (70).

The fan housing (40) is attached to the motor assembly (30) and has a closed side, an open side, a top, a discharge port (41) and a central hole (42). The closed side is attached to the rear of the cylinder of the motor assembly (30). The discharge port (41) is formed in the top of the fan housing (40) and communicates with the open side. The central hole (42) is formed in the closed side and is mounted around the drive shaft (311).

The inlet plate (60) is attached to the open side of the fan housing (40) and has a central hole (61). The central hole (61) is formed through the inlet plate (60).

The inlet manifold (50) is hollow, is attached to the inlet plate (60) optionally against the posts (13) in the casing (10) and has a closed side, an open side, a top, an inlet port (51) and multiple optional posts (52). The open side is attached to the inlet plate (60). The inlet port (51) is formed in the top and communicates with the open side. The posts (52) are formed on the top.

The centrifugal impeller (70) is mounted rotatably in the fan housing (40) and is connected to the drive shaft (311).

The faceplate (90) is mounted in the faceplate frame (14), seals the top opening of the casing (10), connects to the inlet manifold (50) and the motor assembly (30) and has an outer surface, an inner surface, a through hole (91) and multiple optional plugs (92). The through hole (91) is formed through the faceplate (90) and corresponds to the ports (41, 51) in the fan housing (40) and inlet manifold (50). The plugs (92) are formed on the inner surface and correspond to and are mounted securely around the posts (32, 52) on the cylinder of the motor assembly (30) and the top of the inlet manifold (50).

Figure 3:
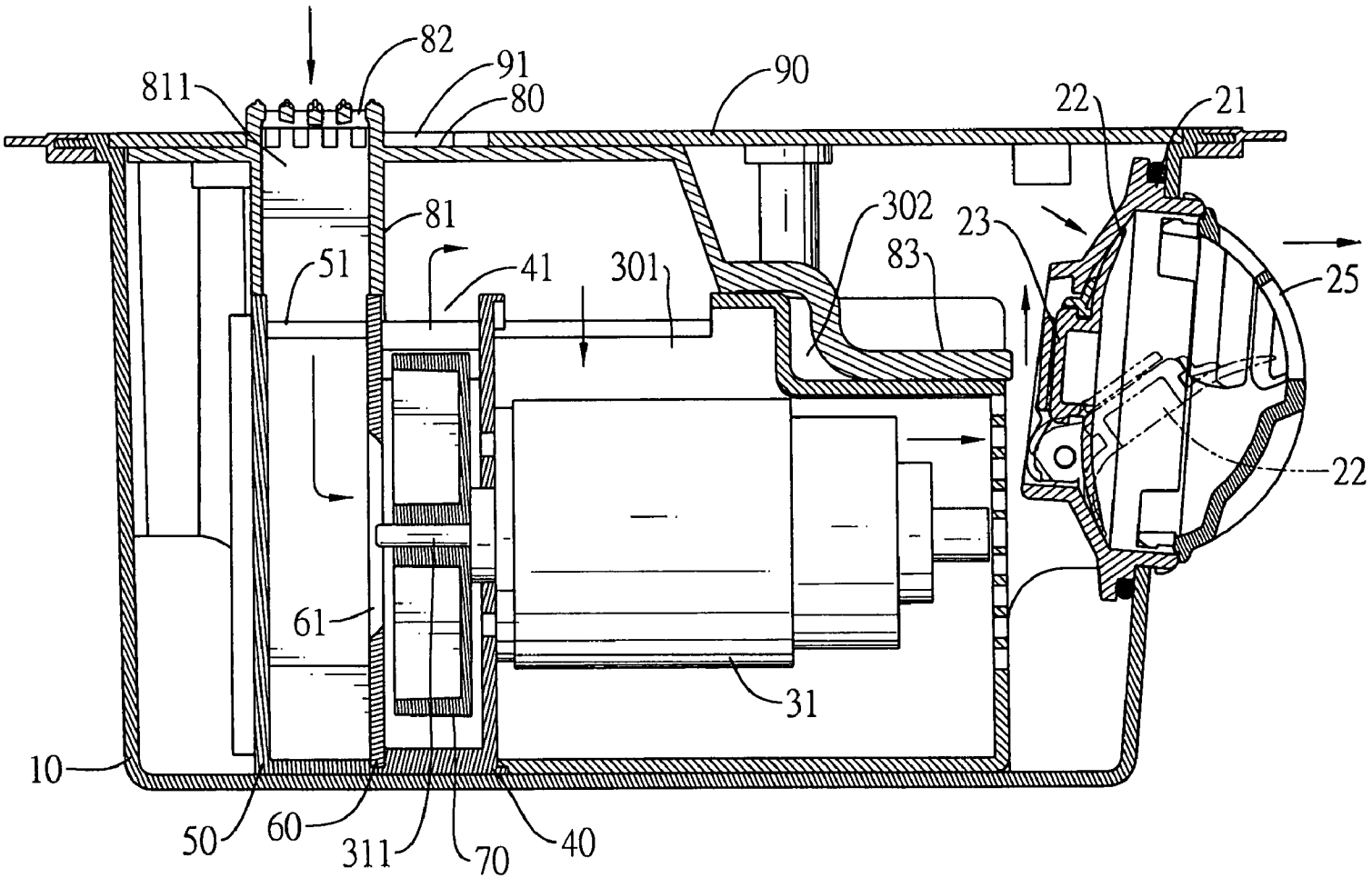
FIG. 3 is an operational side view in partial section of the air pump in FIG. 1 when inflating an inflatable article.

With further reference to FIG. 3, the sliding valve assembly (80) is hollow, is mounted slidably between the faceplate (90) and the motor assembly (30) and has a closed side, an open side, a front, a rear, a partition (81), an air passage (811), multiple vents (82) and a tappet (83). The open side corresponds to the opening (301) in the cylinder and the ports (41, 51) in the fan housing (40) and inlet manifold (50), covers the opening (301) in the cylinder and the discharge port (41) in the fan housing (40) and selectively covers the inlet port (51) in the inlet manifold (50). The partition (81) is formed in the sliding valve assembly (80) and extends from the closed side to the open side. The air passage (811) is formed between the rear and the partition (81) and corresponds to and selectively aligns with one of the ports (41, 51) in the fan housing (40) and inlet manifold (50). The vents (82) are formed in the closed side and corresponds to and communicate with the air passage (811). The tappet (83) is formed on and extends from the front and corresponds to the activator (23) of the check valve assembly (20).

When the air passage (811) is aligned with the inlet port (51) in the inlet manifold (50), the air pump inflates the inflatable articles attached to the check valve assembly (20). Air is drawn into the air passage (811) through the vents (82) and passes through the inlet manifold (50) and the central hole (61) in the inlet plate (60). The centrifugal impeller (70) rotated by the drive shaft (311) of the motor (31) pumps air out through the discharge port (41) in the fan housing (40). The air passes through the cylinder of the motor assembly (30) and the holes in the front of the cylinder and pushes the activator (23) and the disk (22) of the check valve assembly (20). Then the air flows into the inflatable articles through the check valve assembly (20).

Figure 4:
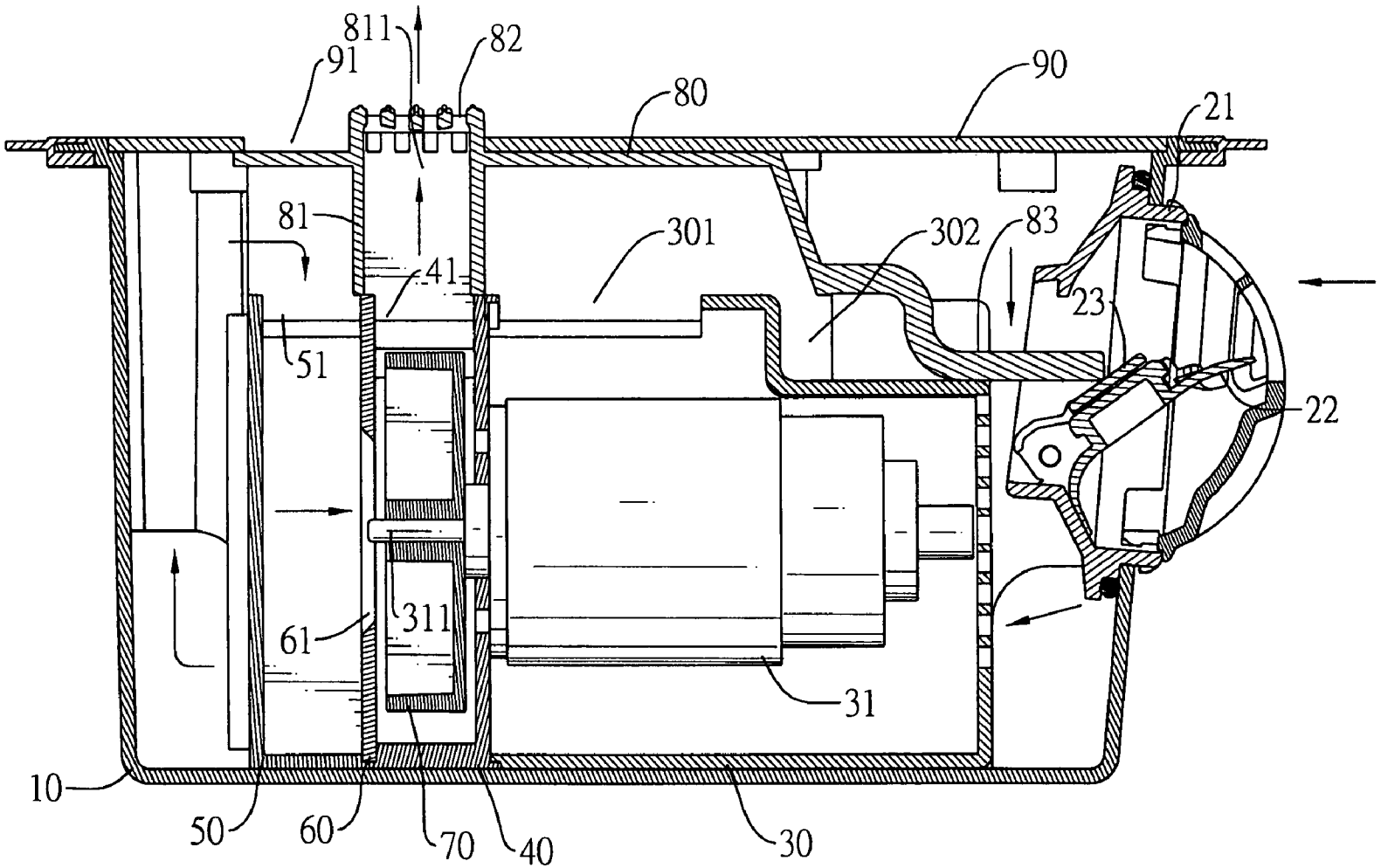
FIG. 4 is an operational side view in partial section of the air pump in FIG. 1 when deflating an inflatable article.

With further reference to FIG. 4, the air pump deflates inflatable articles when the air passage (811) aligns with the discharge port (41) in the fan housing (40). To align the air passage (811) with the discharge port (41), the sliding valve assembly (80) is pushed forward, and the tappet (83) pushes the activator (23). The disk (22) separates from the valve body (21) and opens the inner opening so air in an inflated article attached to the check valve assembly (20) is drawn into the cavity (11) in the casing (10). The motor (31) rotates the centrifugal impeller (70) and pumps air in the cavity (11) out through the discharge port (41) in the fan housing (40) and the air passage (811) and vents (82) in the sliding valve assembly. The air pump continues to draw air from the inflatable article until the inflatable article is completely deflated.

The air pump as described can shift from inflating an article to deflating the article without being disconnected from the inflatable article or reversing the motor (31).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An air pump comprising a casing being hollow and having
- a top;
- a front;
- a cavity;
- inner walls;
- a top opening formed in the top;
- a faceplate frame; and
- a front hole formed through the front;

a check valve assembly mounted in the front hole in the front of the casing and comprising
- a valve body mounted securely in the front hole in the front of the casing and having
  - an inner opening; and
  - an outer opening;
- a disk attached to and closing the inner opening in the valve body and having an inside surface; and
- an activator mounted moveably in the valve body, attached to the inside surface of the disk to selectively push the disk to open the inner opening in the valve base;

a motor assembly mounted in the cavity in the casing and comprising
- a cylinder being hollow and having
  - a front;
  - a rear;
  - a top;
  - multiple holes formed in the front of the cylinder;
  - an opening formed in the rear and top of the cylinder; and
  - a recess formed in the front and top of the cylinder; and
- a motor mounted in the cylinder and having
  - a center; and
  - a drive shaft mounted in the center of the motor and protruding out of the rear of the cylinder;

a fan assembly is mounted in the cavity of the casing, attached to and driven by the motor and comprising
- a fan housing attached to the motor assembly and having
  - a closed side attached to the rear of the cylinder of the motor assembly;
  - an open side;
  - a top;
  - a discharge port formed in the top of the fan housing and communicating with the open side; and
  - a central hole formed in the closed side and mounted around the drive shaft;
- an inlet plate attached to the open side of the fan housing and having a central hole formed in the inlet plate;
- an inlet manifold being hollow, attached to the inlet plate and having
  - a closed side;
  - an open side attached to the inlet plate;
  - a top; and an inlet port formed in the top and communicating with the open side; and a centrifugal impeller mounted rotatably in the fan housing and connected to the drive shaft;

a faceplate mounted in the faceplate frame, sealing the top opening of the casing, connecting to the inlet manifold and the motor assembly and having an outer surface;

an inner surface; and a through hole formed through the faceplate and corresponding to the ports in the fan housing and inlet manifold; and a sliding valve assembly being hollow, mounted slidably between the faceplate and the motor assembly and having a closed side;

an open side corresponding to the opening in the cylinder and the ports in the fan housing and inlet manifold, covering the opening in the cylinder and the discharge port in the fan housing and selectively covering the inlet port in the inlet manifold;

a front;

a rear;

a partition formed in the sliding valve assembly and extending from the closed side to the open side;

an air passage formed between the rear and the partition and corresponding to and selectively aligning with the ports in the fan housing and inlet manifold;

multiple vents formed in the closed side and corresponding to and communicating with the air passage; and a tappet formed on and extending from the front and corresponding to the activator of the check valve assembly.

2. The air pump as claimed in claim 1, wherein the casing further comprises four posts formed vertically on the inner walls in the case;

the motor assembly is mounted against the posts; and the inlet manifold is mounted against the posts.

3. The air pump as claimed in claim 1, wherein the activator of the check valve assembly is mounted pivotally on the valve body.

4. The air pump as claimed in claim 2, wherein the activator of the check valve assembly is mounted pivotally on the valve body.

5. The air pump as claimed in claim 1, wherein the motor assembly further comprises multiple posts formed on the top of the cylinder;

the inlet manifold further has multiple posts formed on the top of the inlet manifold; and the faceplate further has multiple plugs formed on the inner surface and corresponding to and mounted securely around the posts on the cylinder and the inlet manifold.

6. The air pump as claimed in claim 4, wherein the motor assembly further comprises multiple posts formed on the top of the cylinder;

the inlet manifold further has multiple posts formed on the top of the inlet manifold; and the faceplate further has multiple plugs formed on the inner surface and corresponding to and mounted securely around the posts on the cylinder and the inlet manifold.

* * * * *